US007065996B2

(12) United States Patent
Koike et al.

(10) Patent No.: US 7,065,996 B2
(45) Date of Patent: Jun. 27, 2006

(54) ROLLING DIE FOR BALL SCREW

(75) Inventors: Etsuo Koike, Gunma (JP); Hitoshi Sannomiya, Gunma (JP)

(73) Assignee: NSK Ltd., Tokyo (JP)

( * ) Notice: Subject to any disclaimer, the term of this patent is extended or adjusted under 35 U.S.C. 154(b) by 287 days.

(21) Appl. No.: 10/631,808

(22) Filed: Aug. 1, 2003

(65) Prior Publication Data

US 2004/0107755 A1 Jun. 10, 2004

(30) Foreign Application Priority Data

Aug. 2, 2002 (JP) ..... P.2002-226392

(51) Int. Cl.
*B21H 3/04* (2006.01)

(52) U.S. Cl. ..... 72/103; 72/98; 470/66; 470/185

(58) Field of Classification Search ..... 72/98, 72/103, 104, 118; 470/10, 66, 70, 71, 84, 470/185, 187, 188
See application file for complete search history.

(56) References Cited

U.S. PATENT DOCUMENTS 2,720,801 A * 10/1955 Erdelyi et al. ..... 72/100
2,937,547 A 5/1960 Fritz et al.
3,651,678 A * 3/1972 Zook et al. ..... 72/103
3,942,349 A * 3/1976 Williams et al. ..... 72/98
6,708,544 B1 * 3/2004 Sannomiya ..... 72/103

FOREIGN PATENT DOCUMENTS

| | | |
|---|---|---|
| DE | 25 52 860 A1 | 7/1976 |
| DE | 202 02 470 U1 | 7/2002 |
| JP | 9-133195 A | 5/1997 |

* cited by examiner

*Primary Examiner*—Ed Tolan
(74) *Attorney, Agent, or Firm*—Sughrue Mion, PLLC

(57) ABSTRACT

A rolling die for a ball screw has: a cylindrical portion including a helical protrusion formed in an outer peripheral surface thereof for forming a helical ball groove in a raw material of a screw shaft of the ball screw; and a conical lead-in portion formed in one end portion of the cylindrical portion, the lead-in portion including a plurality of frustum-cone-shaped portions, wherein the contact angles of the frustum-cone-shaped portions with respect to the raw material of the screw shaft are each set so as to increase sequentially in the order starting at and from the frustum-cone-shaped portion adjoining the cylindrical portion.

5 Claims, 5 Drawing Sheets

| | PRESENT INVENTION | RELATED ART |
|---|---|---|
| UNIT PRESSURE OR LOWER | 0.010 | 0.085 |
| CONTACT ANGLE DIFFERENCE BETWEEN ROLLING DIE AND SCREW SHAFT | 3.5DEG | 9DEG |

ROLLING DIE FOR BALL SCREW

BACKGROUND OF THE INVENTION

1. Field of the Invention

The present invention relates a rolling die for a ball screw which is used to manufacture the screw shaft of a ball screw.

2. Description of the Related Art

Generally, the screw shaft of a ball screw is formed of a rod-shaped screw shaft raw material made of metal and includes a helical ball groove formed therein. As a method for manufacturing such screw shaft, in JP-A-9-133195, there is disclosed a method in which such a rolling die 10 as shown in FIG. 7. That is, a rolling die 10, which comprises a cylindrical portion 12 including a helical protrusion formed on the outer peripheral surface thereof and further comprises a conical lead-in portion 13 and a conical run-off portion 14 respectively formed in the two end portions of the cylindrical portion 14, is pressed against such a raw material of a screw shaft w as shown in FIG. 8. In this pressed state, one of the rolling die 10 and screw shaft raw material w is rotated with respect to the other to thereby roll and work a ball groove g in the raw material w of the screw shaft. The method disclosed in the cited publication is a so called through feed rolling-type rolling method which uses the walking phenomenon (moving of the product in an axial direction thereof in the rolling process) of the raw material of the screw shaft. When compared with a method for manufacturing a screw shaft by turning or grinding the raw material of the screw shaft to form a ball groove therein, the through feed rolling-type rolling method is excellent in mass production and is able to manufacture a precision ball screw at a relatively low cost.

However, when manufacturing a screw shaft including a ball groove having a pitch larger than the ball diameter using the thread rolling die shown in FIG. 7, that is, as shown in FIG. 9, a screw shaft bs with the pitch p of the ball groove g thereof being 1.7 times or more than the diameter dB of the ball b, there is a possibility that the crushing amount of the raw material per crush by the thread rolling die can be large. This raises a possibility that the circularity deviation and shape transfer property of a ball groove to be rolled and formed in the raw material of the screw shaft can be lowered, thereby being unable to satisfy the required specifications. In order to satisfy the required specifications, in case where the length of the lead-in portion of the rolling die is increased to thereby reduce the raw material crushing amount per crush, the number of working operations increases, thereby causing the raw material of the screw shaft to harden through the working operations, so that exfoliations may occur on the working surface of the raw material of the screw shaft.

Also, in case where a ball groove is rolled and worked in a raw material of a screw shaft using the rolling die shown in FIG. 7, there occurs excessive stress concentration in the boundary portion between the cylindrical portion and lead-in portion of the rolling die, which can shorten the durable life of the rolling die.

SUMMARY OF THE INVENTION

The present invention aims at eliminating the above-mentioned drawbacks found in the conventional rolling die. Accordingly, it is an object of the present invention to provide a rolling die for a ball screw which can reduce the occurrence of the stress concentration in the boundary portion between the cylindrical portion and lead-in portion of the rolling die without increasing the entire width of a roller more than necessary to thereby be able to enhance the circularity deviation and groove-shape precision of the ball groove as well as the durability of the rolling die.

In attaining the above object, according to a first aspect of the present invention, there is provided a rolling die for a ball screw, having: a cylindrical portion including a helical protrusion formed in an outer peripheral surface thereof for forming a helical ball groove in a raw material of a screw shaft of the ball screw; and a conical lead-in portion formed in one end portion of the cylindrical portion, the lead-in portion including a plurality of frustum-cone-shaped portions, wherein the contact angles of the frustum-cone-shaped portions with respect to the raw material of the screw shaft are each set so as to increase sequentially in the order starting at and from the frustum-cone-shaped portion adjoining the cylindrical portion.

According to a second aspect of the present invention, the rolling die for a ball screw as set forth in the first aspect, wherein the lead-in portion includes a first frustum-cone-shaped portion adjoining the cylindrical portion and a second frustum-cone-shaped portion adjoining the first frustum-cone-shaped portion.

The rolling die for a ball screw as set forth in the second aspect, wherein a contact angle of the first frustum-cone-shaped portion is set at an angle of 0.4°, and a contact angle of the second frustum-cone-shaped portion is set at an angle of 4°.

The rolling die for a ball screw as set forth in the second aspect, a run-off portionrun-off portion is formed in the other end portion of the cylindrical portion, a contact angle of the run-off portionrun-off portion is set not more than the contact angle of the first frustum-cone-shaped portion.

The rolling die for a ball screw as set forth in the second aspect, wherein an axial-direction length L of the first frustum-cone-shaped portion is set in the range of $\kappa \leqq L \leqq 10\kappa$, where $\kappa$ expresses the moving amount of the raw material of the screw shaft per ½ rotation.

According to the present structure, since the contact angle of the lead-in portion to be contacted with the raw material of the screw shaft becomes shallower step by step as it approaches the cylindrical portion, the occurrence of the stress concentration in the boundary portion between the cylindrical portion and lead-in portion can be reduced to thereby be able to enhance the durability of the rolling die for a ball screw. Also, because the raw material crushing amount per crush by the rolling die in the finishing portion of the screw shaft can be reduced, even in the case of a screw shaft which has the pitch of the ball groove of which is 1.7 times or more than the diameter of a ball, the screw shaft can be manufactured with high accuracy. Further, since the raw material crushing amount per crush can be reduced only in the finishing portion of the screw shaft, the raw material can be prevented from being hardened through the working operation thereof. Moreover, because there is avoided the need to increase the entire width of the rolling die, the screw shaft of the ball screw can be manufactured at a low cost.

DETAILED DESCRIPTION OF THE PREFERRED EMBODIMENTS

Figure 7:
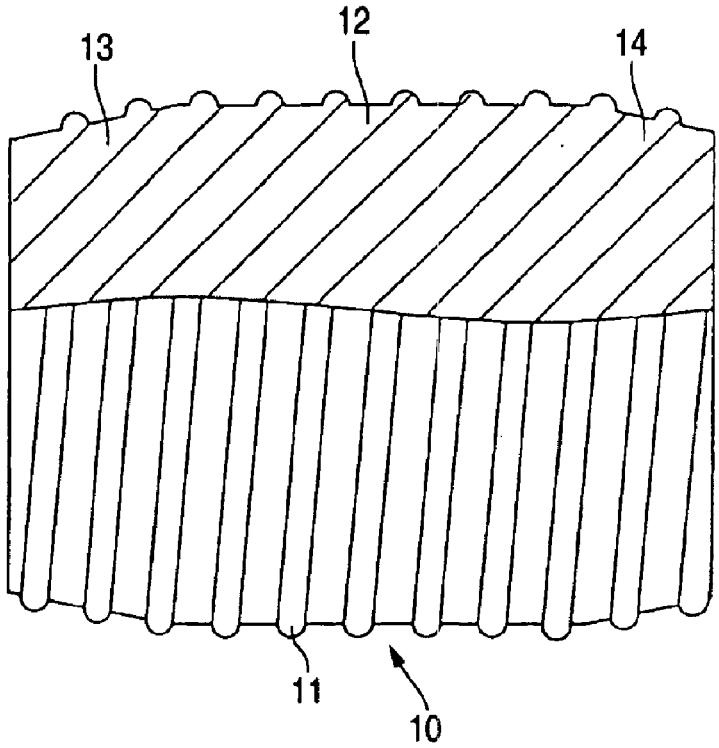
FIG. 7 is a schematic view of a conventional ball screw rolling die.
Figure 8:
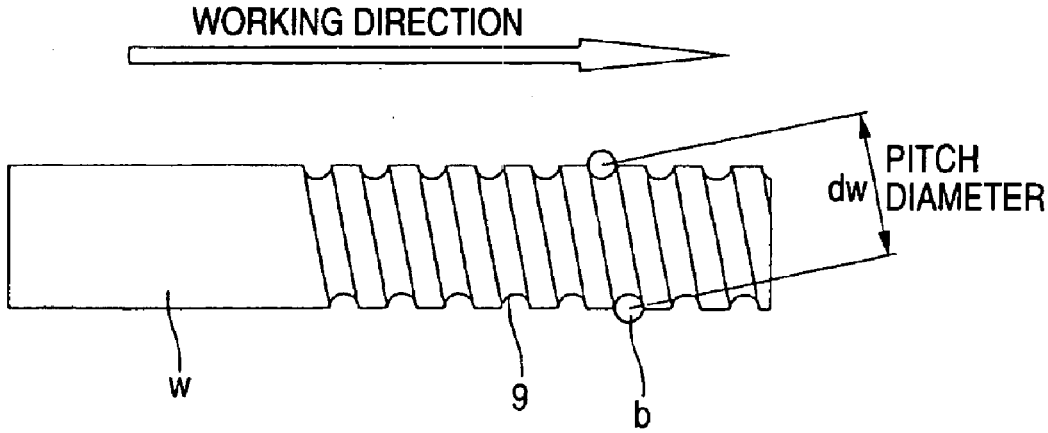
FIG. 8 is a view of a raw material of a screw shaft to be rolled and worked by a ball screw rolling die; and, FIG. 9 is a view of a screw shaft in which the pitch of a ball groove thereof is 1.7 times or more than the diameter of a ball.

Now, description will be given below of an embodiment of a rolling die for a ball screw according to the present invention with reference to the accompanying drawings. By the way, in the present embodiment, the same parts as in the conventional rolling die shown in FIG. 7 are given the same designations and thus the detailed description thereof is omitted here.

Figure 1:
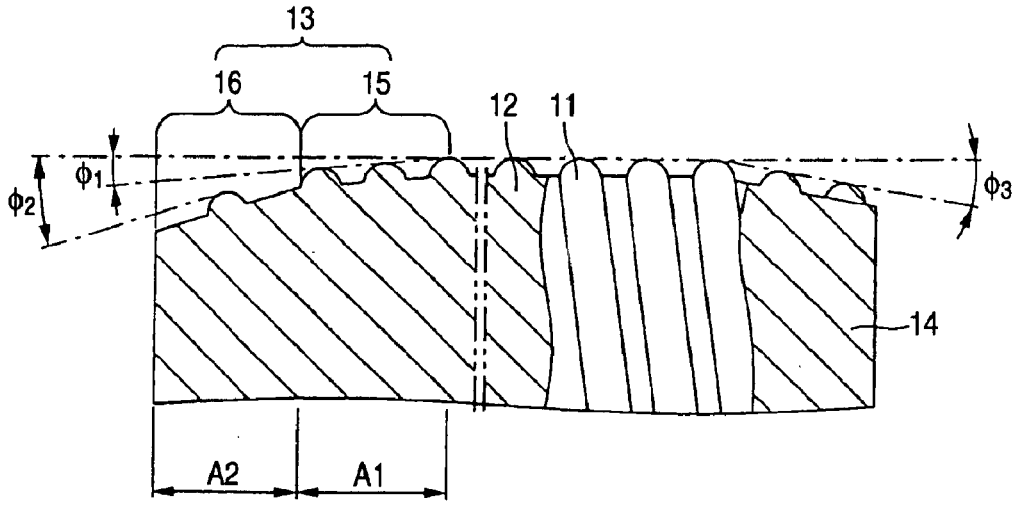
FIG. 1 is a section view of a portion of a ball screw rolling die according to an embodiment of the present invention.

FIG. 1 is a section view of a portion of a rolling die for a ball screw according to an embodiment of the present invention. As shown in FIG. 1, the lead-in portion 13 of the ball screw rolling die according to the present embodiment is composed of a combination of two frustum-cone-shaped portions 15, 16. In the case of these two frustum-cone-shaped portions 15, 16, the irrespective raw material contact angles $\phi 1$,$\phi 2$ with respect to the raw material of the screw shaft are different from each other. Specifically, the raw material contact angle $\phi 1$ of the frustum-cone-shaped portion 15 adjoining the cylindrical portion 12 has the following relation with respect to the raw material contact angle $\phi 2$ of the frustum-cone-shaped portion 16 situated on the leading end side of the frustum-cone-shaped portion 15, that is, $\phi 1<\phi 2$ . In the present embodiment, the raw material contact angle $\phi 1$ of the frustum-cone-shaped portion 15 is set, for example, at an angle of 0.4°, while the raw material contact angle $\phi 2$ of the frustum-cone-shaped portion 16 is set, for example, at an angle of 4°. Also, the axial-direction length of the lead-in portion 13 is set for 55 mm, the frustum-cone-shaped portion 15 has an axial-direction length of 15 mm, and the frustum-cone-shaped portion 16 has an axial-direction length of 40 mm. Further, since it is known that stress concentration occurs also in the connecting portion between the run-off portion 14 and cylindrical portion 12, $\phi 1=\phi 3$ and $\phi 3=0.4°$. Properly speaking, $\phi 3 \leqq \phi 1$ may be preferable; however, since, in case where $\phi 3=\phi 1$, grinding by a piece of grinding stone is possible in manufacturing a rolling die, $\phi 1$ and $\phi 3$ are set the same value (0.4°) in order not to increase the manufacturing cost of the grinding die. The axial-direction length L of the frustum-cone-shaped portion 15 is set in the range of $\kappa \leqq L \leqq 30\kappa$ where $\kappa$ expresses the moving amount of screw shaft raw material (to be discussed later) per ½ rotation. However, the raw material contact angle $\phi 1$ of the frustum-cone-shaped portion 15 in some cases, there is a possibility that the surface of the raw material of the screw shaft can peel off when the raw material is hardened through the working operation; therefore, the axial-direction length L may be preferably set in the range of $\kappa \leqq L \leqq 10\kappa$.

In this manner, in case where the conical lead-in portion 13 to be formed in one end portion of the cylindrical portion 12 is composed of the two frustum-cone-shaped portions 15, 16 and the raw material contact angles $\phi 1$,$\phi 2$ of the frustum-cone-shaped portions 15, 16 are set so as to increase sequentially in the order starting at and from the frustum-cone-shaped portion 15 adjoining the cylindrical portion 12, $\phi 1$,$\phi 2$. That is, the raw material contact angles of the lead-in portion 13 with respect to the raw material of the screw shaft become shallower step by step as they approach the cylindrical portion side, thereby being able to reduce the occurrence of the stress concentration in the boundary portion between the cylindrical portion 12 and lead-in portion 13, which can enhance not only the circularity deviation and groove shape of the ball groove but also the durability of the ball screw rolling die.

Figure 9:
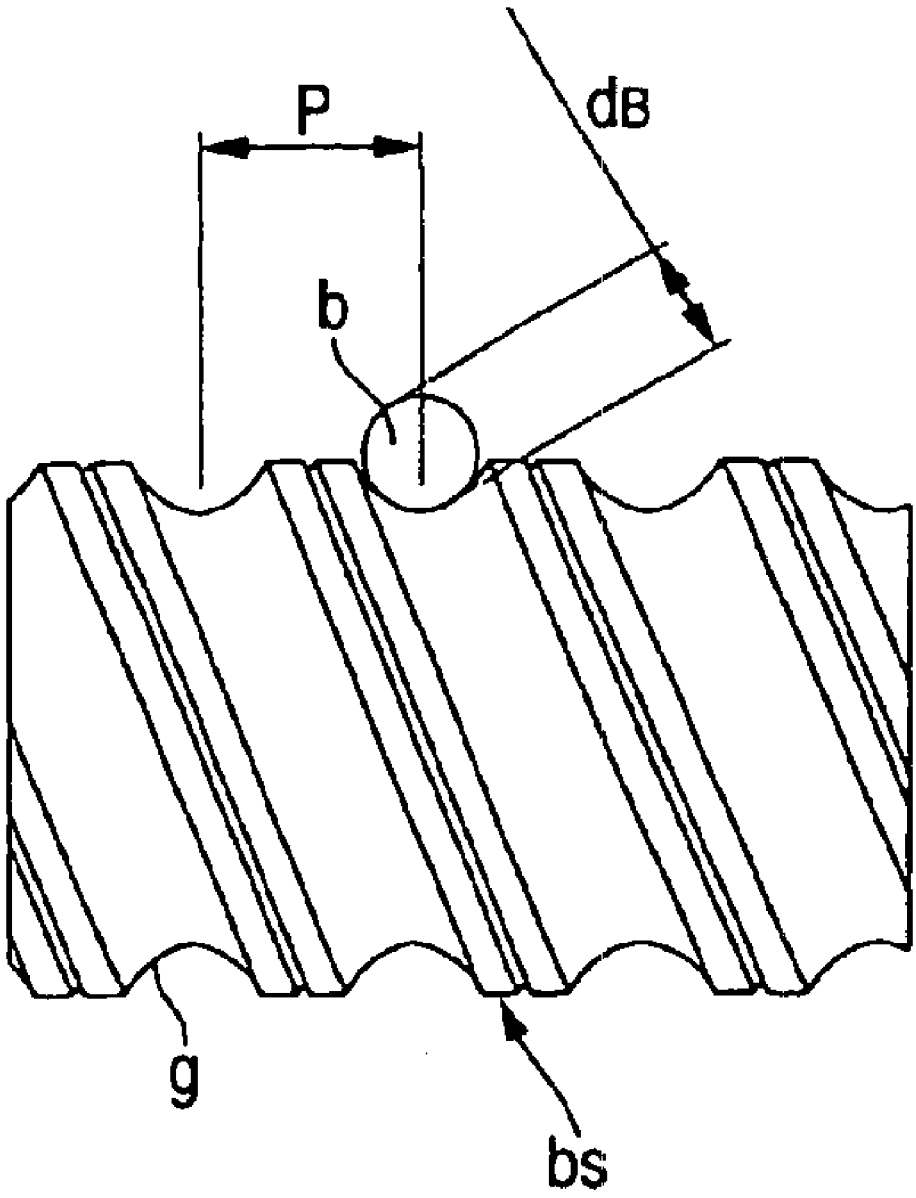

Also, in case where the conical lead-in portion 13 to be formed in one end portion of the cylindrical portion 12 is composed of the two frustum-cone-shaped portions 15, 16 and the raw material contact angles $\phi 1$,$\phi 2$ of the frustum-cone-shaped portions 15, 16 are set so as to increase sequentially in the order starting at and from the frustum-cone-shaped portion 15 adjoining the cylindrical portion 12, the raw material crushing amount per crush can be reduced. Therefore, even in the case of the screw shaft bs shown in FIG. 9, that is, the screw shaft bs with the ball groove g of which has a pitch p 1.7 times or more than the diameter ds of the ball b can be manufactured with high precision by rolling and working the same. Further, there is no need to set the length of the lead-in portion 13 longer than necessary in order to reduce the raw material crushing amount per crush, which makes it possible to restrict the occurrence of the hardening phenomenon of the raw material through the working operation thereof. And, because there is also eliminated the need to increase the entire width of the rolling die, the rolling die can be manufactured at a low cost.

By the way, where the moving amount per ½ rotation of the raw material of the screw shaft is expressed as $\kappa$ and the raw material contact angle of the rolling die with respect to the raw material of the screw shaft is expressed as $\phi$, the raw material crushing amount per crush of the rolling die $\Delta\gamma$ can be expressed by the following equation (1): that is, $$\Delta\gamma=\kappa\cdot\tan\phi \tag{1}$$

And, where the outside diameter of the raw material of the screw shaft is expressed as d and the inclination angle of a main shaft is expressed as $\alpha$, the moving amount $\kappa$ per ½ rotation of the raw material of the screw shaft can be obtained by the following equation: that is, $$\kappa=(\pi\cdot d\cdot\tan\alpha)/2 \tag{2}$$

Also, the inclination angle of the main shaft $\alpha$ can be obtained by the following equation: that is, $\alpha=\omega 3-\omega B$, where $\omega 3$ expresses the lead angle of a product to be obtained and $\omega B$ expresses the lead angle of the rolling die. The value of $\phi 1$ is set in such a manner that a numerical value obtained by substituting the equation (2) for the equation (1) is 0.05 mm or less. Also, in FIG. 1, the axial-direction length A1 of the frustum-cone-shaped portion 15 is set equal to or more than the moving amount per ½ rotation of the raw material of the screw shaft.

Figure 2:
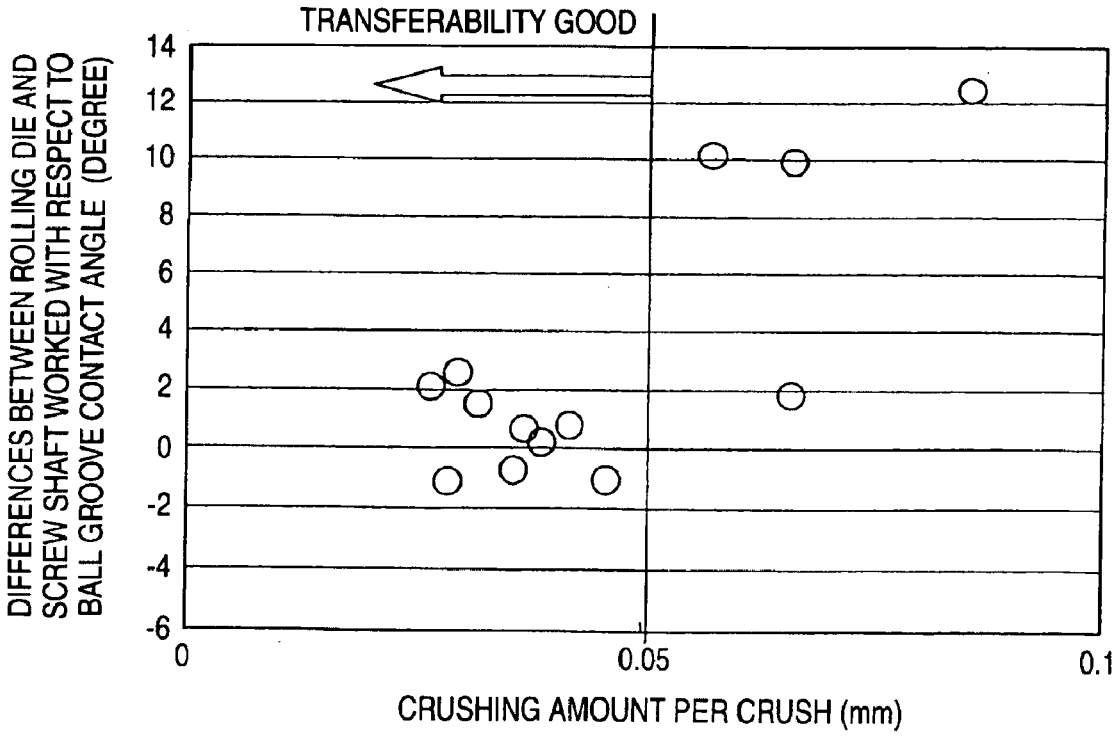
FIG. 2 shows the relationship between the contact angle differences between a rolling die and a raw material of a screw shaft and the raw material crushing amounts per crush.

Now, FIG. 2 shows test data on the raw material crushing amount per crush and test data on the transfer side of the groove shape of the screw shaft worked. In FIG. 2, the horizontal axis shows the raw material crushing amount per crush to be obtained from the design of the rolling die, while the vertical axis shows a difference between the ball contact angle α 2' of the ball groove of the shaft worked by the rolling die and the ball contact angle α2 of the rolling die. This shows that, in case where the raw material crushing amount per crush when raw material is worked using the conventional rolling die shown in FIG. 7 is 0.5 mm or more, it is difficult to transfer the ball groove with high precision. On the other hand, in case where, using the rolling die according to the present invention shown in FIG. 1, in which the lead-in portion thereof is composed of a plurality of frustum-cone-shaped portions and the raw material contact angles thereof are set so as to increase gradually in the order starting at and from the frustum-cone-shaped portion adjoining the cylindrical portion, the crushing amount per crush in the finishing operation is set equal to or less than 0.05 mm, the difference between the contact angles of the rolling die and that of the groove shape of the screw shaft worked is reduced, thereby being able to transfer the ball groove with high precision.

Figures 3, 4:
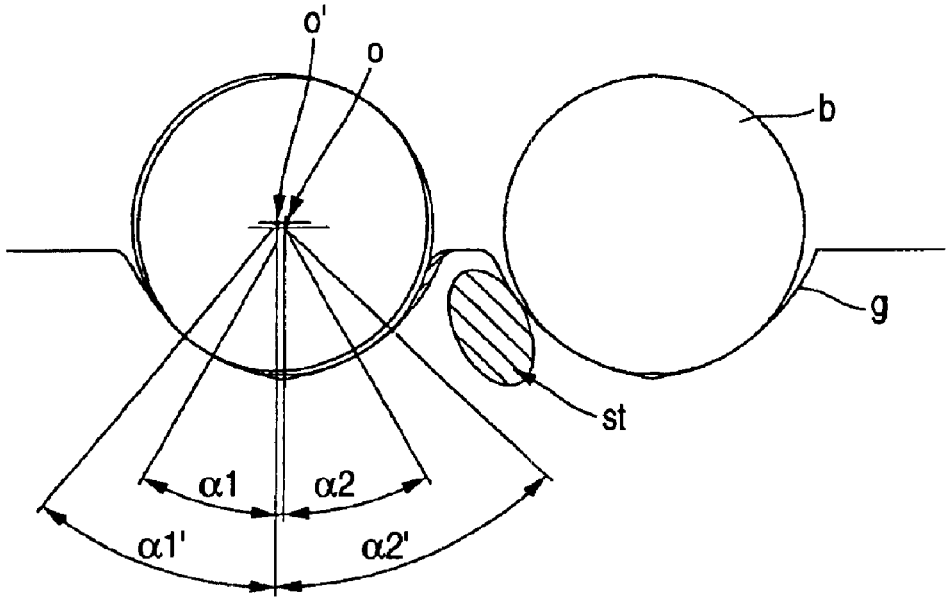
FIG. 3 is an explanatory view of the operation to be executed when the raw material crushing material per crush is set 0.05 mm or less.
FIG. 4 shows differences between the contact angle of a ball screw rolling die according to the present invention and that of a conventional ball screw rolling die with respect to the raw material of the screw shaft.

Also, in case where a rolling die is structured in an ideal shape using the contact angles α1, α2, the contact angle of the groove shape of the screw shaft worked, as shown in FIG. 3, varies into α1', α2', according to the value of the raw material crushing amount per crush of the rolling die Δγ. In case where Δγ is set equal to or less than 0.05 mm, differences between α1 and α1' and between α2 and α2' can be reduced. By the way, in FIG. 3, O designates the center of the ball b when the ball groove g is rolled and worked in an ideal shape in the raw material w of the screw shaft, while O' designates the center of the ball b when the ball groove g is rolled and worked in a distorted shape in the raw material w of the screw shaft.

Now, FIG. 4 shows the contact angle difference the groove shapes of the screw shafts respectively rolled and worked by between the ball screw rolling die according to the present invention and the conventional ball screw rolling die. As shown in FIG. 4, in case where the ball screw rolling die according to the present invention is used, the contact angle difference between the rolling die and the screw shaft worked becomes 3° or less, which shows that the contact angle difference can be reduced over the conventional rolling die.

Figure 5:
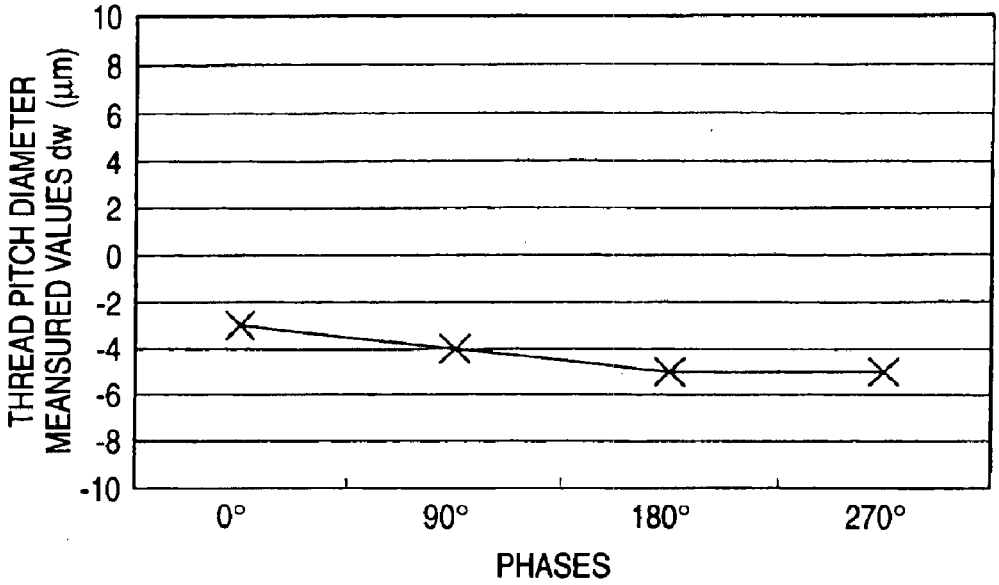
FIG. 5 is a graphical representation of variations in measured values obtained by measuring the pitch diameters of a ball groove rolled and worked in a raw material of a screw shaft using a ball screw rolling die according to the present invention.

FIG. 5 shows variations in measured values obtained by measuring the pitch diameters of the ball groove rolled and worked in the raw material of the screw shaft over one lead of the screw shaft using the ball screw rolling die according to the present invention. And, FIG. 6 shows variations in measured values obtained by measuring the pitch diameters of the ball groove rolled and worked in the raw material of the screw shaft over one lead of the screw shaft using the conventional ball screw rolling die.

Figure 6:
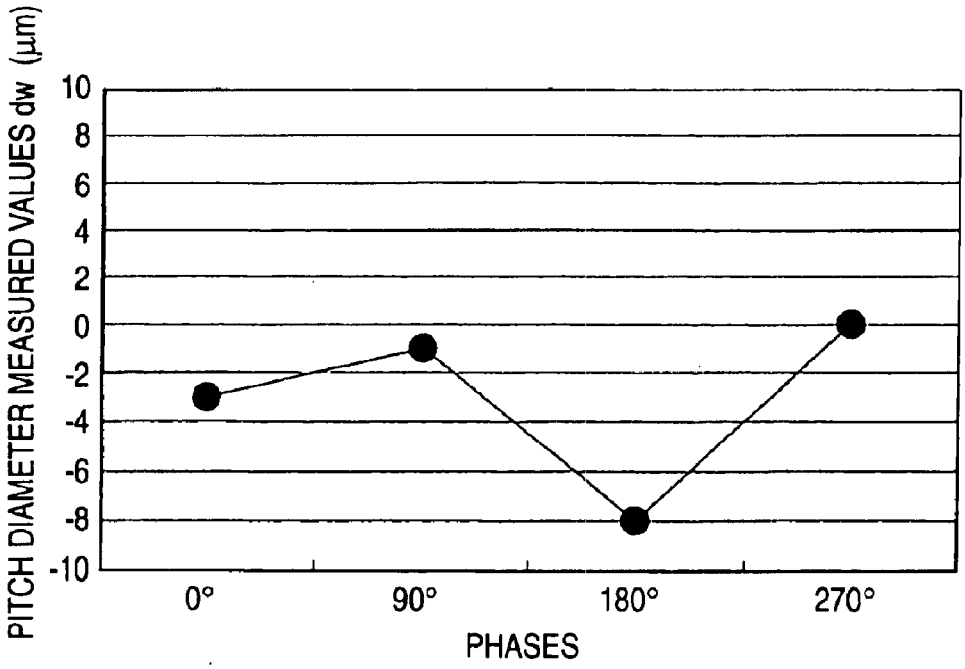
FIG. 6 is a graphical representation variations in measured values obtained by measuring the pitch diameters of a ball groove rolled and worked in a raw material of a screw shaft using a conventional ball screw rolling die.

As can be clearly seen from FIGS. 5 and 6, in the case of the conventional rolling die, the variations in the pitch diameters for one lead are in the range of 4–8 μm; and, on the other hand, in the case of the ball screw rolling die according to the present invention, the variations in the thread pitch diameters for 1 lead are 3 μm or less.

Therefore, in case where the lead-in portion of a rolling die is composed of a plurality of frustum-cone-shaped portions and the raw material contact angles of these frustum-cone-shaped portions are set so as to increase sequentially in the order starting at and from the frustum-cone-shaped portion adjoining the cylindrical portion, even when manufacturing a screw shaft in which the pitch of the ball groove thereof is larger than the diameter of the ball, a desired ball groove can be rolled and worked in the raw material w of the screw shaftith high precision.

By the way, the present invention is not limited to the above-mentioned embodiment. For example, in the above embodiment, the lead-in portion 13 is composed of the two frustum-cone-shaped portions 15, 16; however, the lead-in portion 13 may also be structured by combining together three or more frustum-cone-shaped portions.

As has been described heretofore, according to the present invention, since the conical lead-in portion is composed of a plurality of frustum-cone-shaped portions and the contact angles of these frustum-cone-shaped portions are set so as to increase sequentially in the order starting at and from the frustum-cone-shaped portion adjoining the cylindrical portion, the raw material contact angles of the lead-in portion with respect to the raw material of the screw shaft become shallower step by step as they approach the cylindrical portion side. This can reduce stress concentration which can occur in the boundary portion between the cylindrical portion and lead-in portion, thereby being able to enhance the durability of the ball screw rolling die. Also, since the raw material crushing amount per crush in the lead-in portion can be reduced, even in the case of a screw shaft the pitch of the ball groove of which is larger than the diameter of the ball, the screw shaft can be manufactured with high precision. Further, because there is eliminated the need to set the length of the lead-in portion longer than necessary in order to reduce the raw material crushing amount per crush in the lead-in portion, the hardening phenomenon of the raw material through the rolling operation thereof can be restricted. And, since there is avoided the need to increase the entire width of the rolling die, the rolling die can be manufactured at a low cost.

What is claimed is:

1. A rolling die for a ball screw, comprising:

a cylindrical portion including a helical protrusion formed in an outer peripheral surface thereof for forming a helical ball groove in a raw material of a screw shaft of the ball screw; and a conical lead-in portion formed in one end portion of the cylindrical portion, the lead-in portion including a plurality of frustum-cone-shaped portions, wherein the contact angles of the frustum-cone-shaped portions with respect to the raw material of the screw shaft are each set so as to increase sequentially in the order starting at and from the frustum-cone-shaped portion adjoining the cylindrical portion.

2. The rolling die for a ball screw as set forth in claim 1, wherein the lead-in portion includes a first frustum-cone-shaped portion adjoining the cylindrical portion and a second frustum-cone-shaped portion adjoining the first frustum-cone-shaped portion.

3. The rolling die for a ball screw as set forth in claim 2, wherein a contact angle of the first frustum-cone-shaped portion is set at an angle of 0.4°, and a contact angle of the second frustum-cone-shaped portion is set at an angle of 4°.

4. The rolling die for a ball screw as set forth in claim 2, a run-off portion is formed in the other end portion of the cylindrical portion, a contact angle of the run-off portion is set not more than the contact angle of the first frustum-cone-shaped portion.

5. The rolling die for a ball screw as set forth in claim 2, wherein an axial-direction length L of the first frustum-cone-shaped portion is set in the range of $\kappa \leqq L \leqq 10\kappa$, where κ expresses the moving amount of the raw material of the screw shaft per ½ rotation.

* * * * *